US006402460B1

(12) United States Patent
Fischer et al.

(10) Patent No.: US 6,402,460 B1
(45) Date of Patent: Jun. 11, 2002

(54) ABRASION WEAR RESISTANT FUEL PUMP

(75) Inventors: John Gardner Fischer, Goodrich; John J. Giacchina, Davison; Ismat Ali Abu-Isa, Rochester Hills, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/629,688

(22) Filed: Aug. 1, 2000

(51) Int. Cl.[7] ..... F04D 1/04; F04B 17/00

(52) U.S. Cl. ..... 415/55.1; 417/423.1; 417/423.14

(58) Field of Search ..... 415/55.1, 55.5, 415/55.6, 55.7; 417/423.1, 423.4, 423.14

(56) References Cited

U.S. PATENT DOCUMENTS 3,846,045 A * 11/1974 Mincuzzi ..... 416/230
4,492,515 A * 1/1985 Watanabe et al. ..... 415/55.5
5,248,238 A * 9/1993 Ishida et al. ..... 415/55.1
5,310,308 A * 5/1994 Yu et al. ..... 415/55.6
5,409,357 A * 4/1995 Yu et al. ..... 417/423.1
5,921,746 A * 7/1999 Yu et al. ..... 415/55.1
6,095,771 A * 8/2000 Schelhas et al. ..... 417/423.14
6,113,363 A * 9/2000 Talaski ..... 417/423.3

* cited by examiner

*Primary Examiner*—John E. Ryznic
(74) *Attorney, Agent, or Firm*—Vincent A. Cichosz

(57) ABSTRACT

An abrasion wear resistant fuel pump for a vehicle includes a pump section having a flow channel and a rotatable impeller cooperating with said flow channel to pump fuel therethrough. The fuel pump also includes a motor section disposed adjacent the pump section and having a motor to rotate the impeller. The fuel pump further includes an outlet section disposed adjacent the motor section to allow pumped fuel to exit the fuel pump. The pump section includes a plurality of plates disposed axially adjacent to and cooperating with the impeller. The impeller and plates are made of a composite material that improves abrasion wear characteristics therebetween.

20 Claims, 3 Drawing Sheets

ABRASION WEAR RESISTANT FUEL PUMP

TECHNICAL FIELD

The present invention relates generally to fuel pumps for vehicles and, more particularly, to an abrasion wear resistant fuel pump for a vehicle.

BACKGROUND OF THE INVENTION

It is known to provide a fuel tank in a vehicle to hold fuel to be used by an engine of the vehicle. It is also known to provide a fuel pump to pump fuel from the fuel tank to the engine. One type of fuel pump is known as a high-pressure turbine fuel pump. The high-pressure turbine fuel pump typically includes a plastic impeller rotatable between anodized aluminum plates. The anodized aluminum material of the plates provides for a hard abrasion wear resistant surface. However, a die casting process used to form the plates limits the geometric complexity and surface smoothness of a flow channel and port areas of the plates. Also, secondary operations are required for surface anodization and insertion of a journal bearing. Improved geometry and surface smoothness can be obtained using injection or compression molded plastic plates. However, plastic plates have traditionally been limited in their applications due to poor abrasion wear resistance. Otherwise, the sealing surfaces of the plates wear, resulting in a reduction of fluid flow output.

Therefore, it is desirable to provide a material composition that improves the abrasive wear characteristics of plates in a fuel pump for a vehicle. It is also desirable to provide an abrasion wear resistant fuel pump for a fuel tank in a vehicle. It is further desirable to provide plates in a fuel pump that improve flow channel, port geometry and surface smoothness.

SUMMARY OF THE INVENTION

It is, therefore, one object of the present invention to provide an abrasion wear resistant fuel pump for a vehicle.

It is another object of the present invention to provide a fuel pump for a vehicle having plates made of a material composition that improves the abrasive wear characteristics of a plastic material.

To achieve the foregoing objects, the present invention is a fuel pump for a vehicle including a pump section having a flow channel and a rotatable impeller cooperating with said flow channel to pump fuel therethrough. The fuel pump also includes a motor section disposed adjacent the pump section and having a motor to rotate the impeller. The fuel pump further includes an outlet section disposed adjacent the motor section to allow pumped fuel to exit the fuel pump. The pump section includes a plurality of plates disposed axially adjacent to and cooperating with the impeller. The impeller and plates are made of a composite material that improves abrasion wear characteristics therebetween.

One advantage of the present invention is that an abrasion wear resistant fuel pump is provided for a vehicle. Another advantage of the present invention is that the abrasion wear resistant fuel pump uses a material composition that improves the abrasive wear characteristics of a plastic material. Yet another advantage of the present invention is that the abrasion wear resistant fuel pump reduces cost by eliminating or reducing secondary operations and additional components. Still another advantage of the present invention is that the abrasion wear resistant fuel pump improves performance and durability of the fuel pump due to improved flow channel, port geometry and surface smoothness.

Other objects, features and advantages of the present invention will be readily appreciated, as the same becomes better understood, after reading the subsequent description taken in conjunction with the accompanying drawings.

DESCRIPTION OF THE PREFERRED EMBODIMENT

Figure 1:
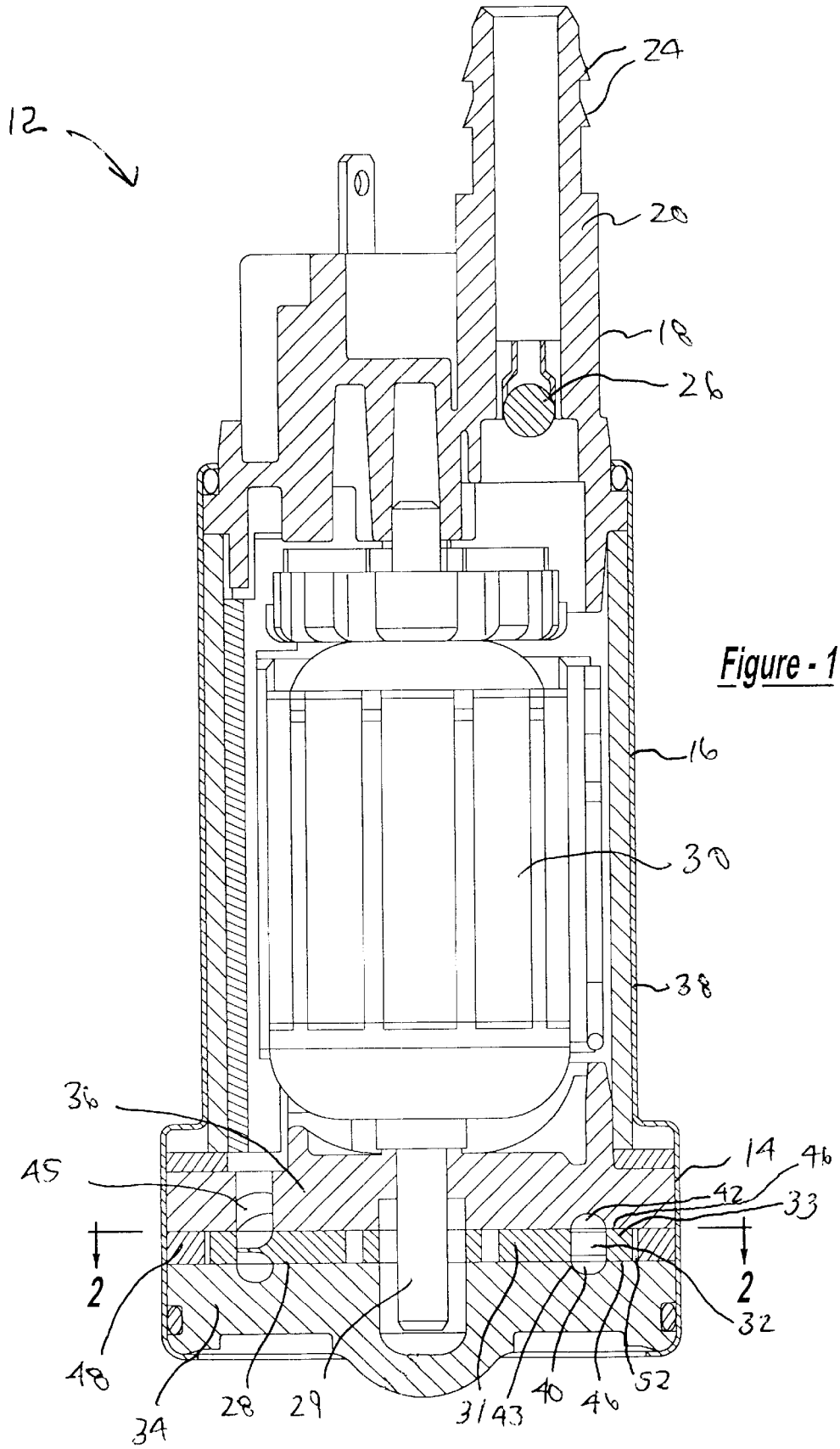
FIG. 1 is a fragmentary elevational view of an abrasion wear resistant fuel pump, according to the present invention.
Figure 2:
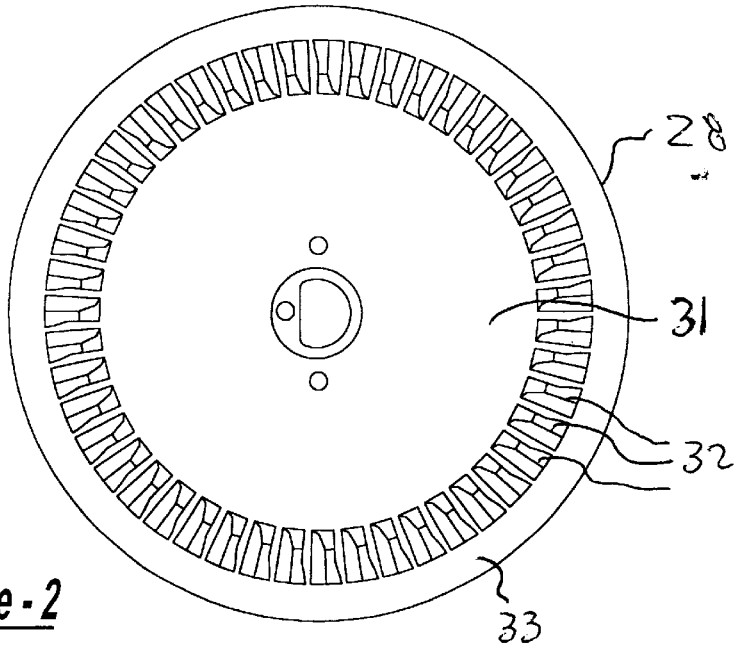
FIG. 2 is a sectional view taken along line 2—2 of FIG. 1.

Referring to the drawings and in particular FIGS. 1 and 2, one embodiment of an abrasion wear resistant fuel pump 12, according to the present invention, is shown for a vehicle (not shown). The abrasion wear resistant fuel pump 12 includes a pump section 14 at one axial end, a motor section 16 adjacent the pump section 14 and an outlet section 18 adjacent the motor section 16 at the other axial end. As known in the art, fuel enters the pump section 14, which is rotated by the motor section 16, and is pumped past the motor section 16 to the outlet section 18. The outlet section 18 has an outlet member 20 extending axially with a passageway 22 extending axially therethrough. The outlet member 20 also has a plurality of projections or barbs 24 extending radially outwardly for attachment to a conduit (not shown). The outlet member 20 also includes a check valve 26 disposed in the passageway 22. It should be appreciated that the fuel flowing to the outlet section 18 flows into the outlet member 20 and through the passageway 22 and check valve 26 when open to the conduit. It should also be appreciated that, except for the pump section 14, the fuel pump 12 is conventional and known in the art.

Referring to FIGS. 1 and 2, the pump section 14 includes an impeller 28 mounted to a rotatable shaft 29 of a motor 30 of the motor section 16 for rotation therewith. The impeller 28 is generally planar and circular in shape. The impeller 28 has a hub portion 31 attached to the shaft 29 by suitable means (not shown). The impeller 28 also has a plurality of blade tips 32 extending radially from the hub portion 31 and disposed circumferentially thereabout. The impeller 28 has a peripheral ring portion 33 extending radially from the blade tips 32 to shroud the blade tips 32. The impeller 28 is made of a rigid material such as plastic.

The pump section 14 also includes an inlet plate 34 disposed axially on one side of the impeller 28 and an outlet plate 36 disposed axially on the other side of the impeller 28. The inlet plate 34 and outlet plate 36 are generally planar and circular in shape. The inlet plate 34 and outlet plate 36 are enclosed by a housing 38 and fixed thereto. The inlet plate 34 and outlet plate 36 have an inlet or first recess 40 and an outlet or second recess 42, respectively, located axially opposite the blade tips 32 adjacent to the peripheral ring portion 33 to form a flow channel 43 for a function to be described. The recesses 40 and 42 are annular and allow fuel to flow therethrough from an inlet port (not shown) to an outlet port 45 of the pump section 14. The peripheral ring portion 33 of the impeller 28 forms an outside diameter (OD) sealing surface 46 on both axial sides thereof with the inlet plate 34 and outlet plate 36. It should be appreciated that the impeller 28 rotates relative to the inlet plate 34 and outlet plate 36 and the inlet and outlet plates 34 and 36 are stationary.

The pump section 14 also includes a spacer ring 48 disposed axially between the inlet plate 34 and outlet plate 36 and spaced radially from the impeller 28. The spacer ring 48 is fixed to the housing 38 and is stationary relative to the impeller 28. The spacer ring 48 is generally planar and circular in shape. The spacer ring 48 has an inner diameter 50 that is spaced from the outside diameter of the peripheral portion 33 of the impeller to form an outside diameter (OD) cavity 52 between the inner diameter 50 of the spacer ring 48 and an outside diameter of the peripheral ring portion 33 of the impeller 28. It should be appreciated that fluid flows through both the inlet plate recess 40 and the outlet plate recess 42 and enters both recesses 40 and 42 at the inlet port region and exits out the outlet port region. It should also be appreciated that abrasion wear resistant material is required on plate and impeller sealing surfaces.

The impeller 28, inlet plate 34 and/or outlet plate 36 are made of a composite material to improve the material abrasive wear resistance. The composite material is a plastic base resin material 54 filled with a filler material 56 (FIG. 3), for example Zirconium Oxide, $R_c$=71, that has a hardness equal to or greater than the hardness of an abrasive contaminant, for example quartz, $R_c$=64, silica ingested by the fuel pump 12 during operation and causing abrasive wear. The concentration and size of the filler material 56 are of a magnitude required to produce 60% to 90% surface area coverage after a lapping operation to be described. This provides a hard contact surface for the abrasive contaminant to transverse without cutting into the base resin material 54 or filler material 56. The filler material 56 is bonded to the base resin material both mechanically and chemically such that a retention force between the filler material 56 and the base resin material 54 is greater than a removal force exerted by the abrasive contaminant to dislodge the filler material 56. This prevents the filler material 56 from being dislodged during abrasive wear conditions. Also, the composite material may include impact modifiers added to the base resin material 54 to improve ductility, hardness and toughness and minimize material loss due to brittle fracture caused by impact forces with the abrasive contaminant.

The composite material is molded to make fuel pump parts such as the impeller 28, inlet plate 34 and/or outlet plate 36 with improved wear resistance, improving durability of the fuel pump 12. The requirements for materials used for making fuel pump parts include a high value of flexural strength (greater than 130 MPa), a high value of flexural modulus (greater than 7 GPa) and an ability to produce smooth injection molded part surfaces. To accomplish this, the base resin material content of the composite material should not be less than 10% by weight of the total composition of the composite material. For this weight percentage, the equivalent volume content is 35% base resin material 54 and 65% filler material 56. For a homogeneous blend of base resin material 54 and filler material 56, to maximize surface coverage by the filler material 56, the surface to volume ratio is increased by using smaller particle sizes for efficient packing. Efficient packing is accomplished by choice of particle geometry and by the use of two sized, differing by a factor of seven, and a concentration ratio of 75/25 large to small particles. It should be appreciated that a combination of small and large particles are used to improve surface area, packing efficiency and maintain other desired properties. It should also be appreciated that the filler size/diameter must be large enough to hold it within the base resin material 54. It should further be appreciated that the filler concentration is large enough to cover approximately 70% to 80% of a final lapped surface to be described.

The adhesion between the filler material 56 and the base resin material 54 is required. Some of the metal oxide fillers such as Zirconium Oxide exhibit good adhesion with the base resin. Other fillers such as silica require pretreating with a wetting agent prior to compounding.

The wear resistance of the base resin material 54 is required. To accomplish this, the phenolic base resin material 54 is modified with the addition of a phenoxy resin of the general formula:

$$—[O\text{-}PHENYL\text{-}C(CH_3)_2\text{-}PHENYL\text{-}O—CH_2—CH(OH)—CH_2—]_n—$$

where n has a value of twenty (20) to one hundred (100). The phenoxy resin will impart impact resistance to the phenolic compound and make it less brittle to eliminate chipping and micro-cracking. Micro-cracking, that occurs when the filler material 56 is pushed against the base resin material 54 by the abrading particle of the abrasion contaminant, is decreased by improved impact strength of the matrix. It should be appreciated that abrasion due to this mechanism will also decrease.

The composite material may be modified by increasing the cross-link density to harden the base resin material 54 and improve its tear strength. Abrading particles of the abrasive contaminant will not readily dig in and tear the base resin material 54, which promote cutting and abrasion. The above novel combinations of factors influencing abrasion are demonstrated in the formulations of Table 1 below.

TABLE 1

Phenolic Formulations For Abrasion Resistance

| Ingredients | Formulations | | | | | | | | |
|---|---|---|---|---|---|---|---|---|---|
| (wt. %) | 1 | 2 | 3 | 4 | 5 | 6 | 7 | 8 | 9 |
| Phenolic Resin | 20 | 17 | 20 | 20 | 17 | 17 | 17 | 17 | 17 |
| Phenoxy PKHH | — | 3 | — | — | 3 | 3 | 3 | 3 | 3 |
| Hexamethylene-Tetramine | 3 | 3 | 3 | 6 | 6 | 6 | 6 | 6 | 6 |
| Milled ZrO2 | | | | | | | | | |
| Size 30 micron (large) | 67 | 67 | 49 | 64 | 47 | — | — | — | 47 |
| Size 4 micron (small) | — | — | 18 | — | 17 | — | — | — | 17 |
| Giass Fiber Chopped ⅛ inch | 10 | 10 | 10 | 10 | 10 | 10 | 10 | 10 | 10 |
| Platy Silica (Treated) | | | | | | | | | |
| Novakup 200 (11–19 u) | — | — | — | — | — | 47 | — | — | — |
| Novakup L337 (2–3.5 u) | — | — | — | — | — | 17 | — | — | — |
| ZrO2 Beaded | | | | | | | | | |
| Large Size | — | — | — | — | — | — | 47 | — | — |
| Small Size | — | — | — | — | — | — | 17 | — | — |
| Silica (tear drop) | | | | | | | | | |
| Tamsil 150 (19.8u) | — | — | — | — | — | — | — | 47 | — |
| Tamsil 10 (2.2u) | — | — | — | — | — | — | — | 17 | — |

The above formulations are examples of compositions of the composite material that would improve abrasion resistance and enhance durability of fuel pump parts. It should be appreciated that improved wear resistance of two stage injection molded phenolic compounds is achieved by using a novel combination of matrix/filler interactions. It should also be appreciated that the resultant abrasion resistant composite material will have a toughened, highly cured base resin material 54, and a hard filler material 56 covering up to 90% of the exposed surface. It should further be appreciated that higher filler surface area is achieved by efficient packing of filler particles having selected shapes and sizes.

Figure 3:
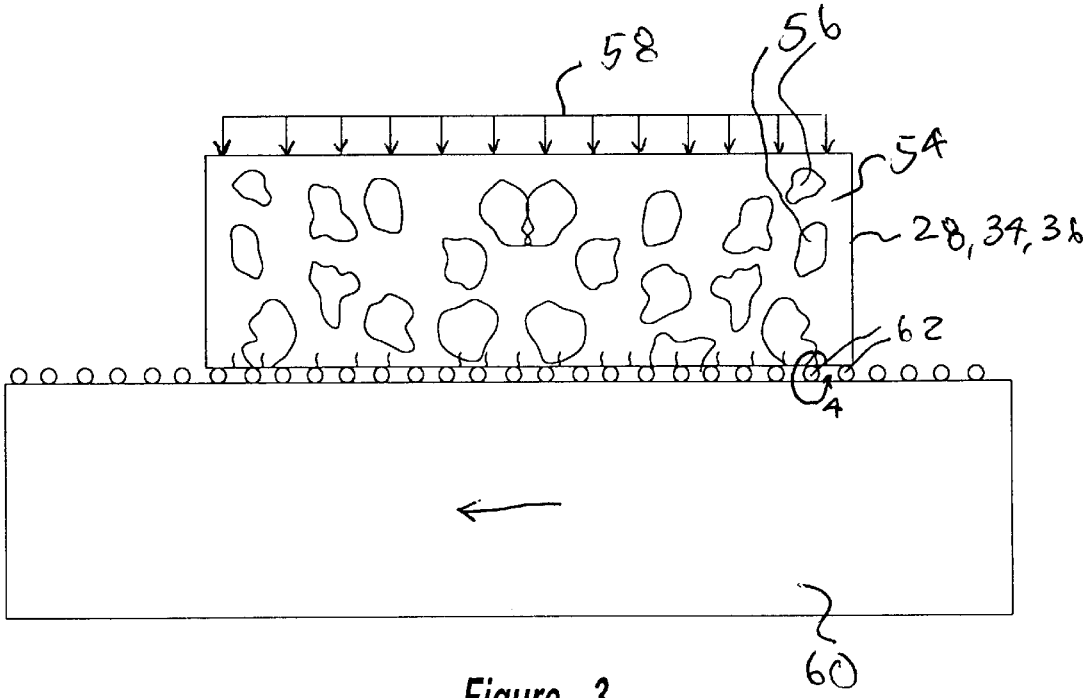
FIG. 3 is an elevational view of a portion of FIG. 2 illustrated in a lapping operation.
Figure 4:
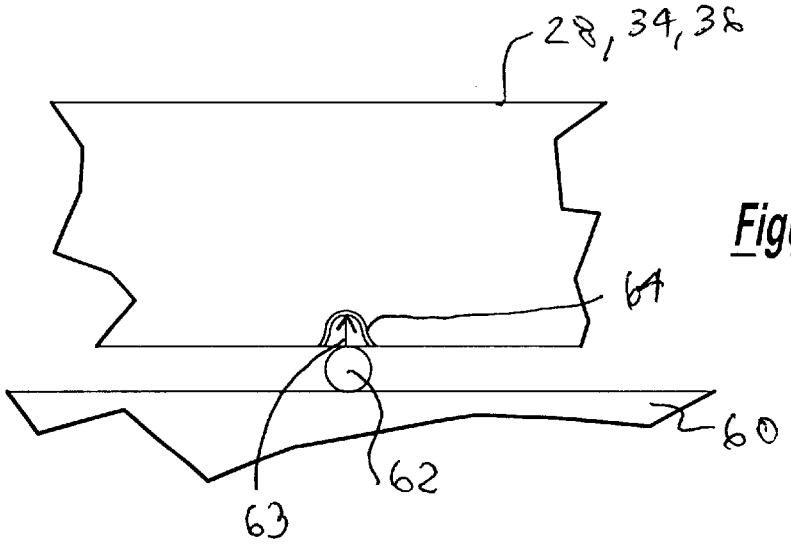
FIG. 4 is an enlarged fragmentary elevational view of the lapping operation of FIG. 3.
Figure 5:
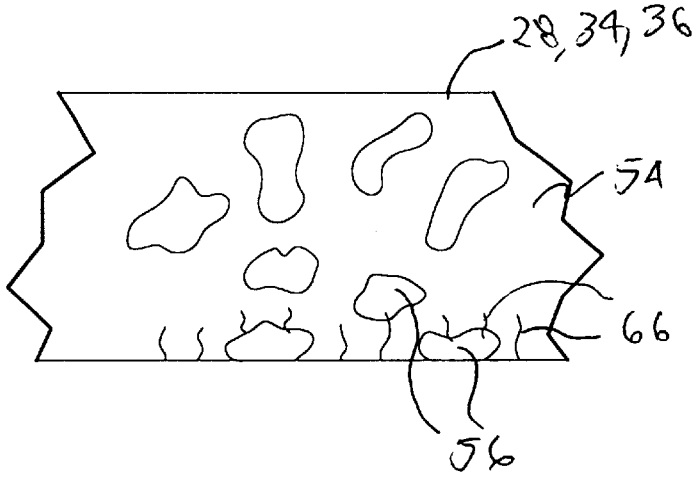
FIG. 5 is an enlarged view of the portion of FIG. 2 illustrated in the lapping operation of FIG. 3.

Referring to FIGS. 3 through 6, the impeller 28 and plates 34 and 36 require a lapping operation after molding to establish flat surfaces such as the sealing surface 46 for improved sealing characteristics. As illustrated in FIG. 3, the lapping operation includes placing a load 58 against the impeller 28 or plates 34,36, which places a desired surface against a flat rotating wheel 60 that contain a fine hard abrasive media 62 such as 25 micron commercial diamond. As illustrated in FIG. 4, a contact force 63 as a result of localized high unit loading of a hard abrasive media 62 into the desired surface creates a fracture zone 64 that allows for material removal. However, it is possible that a residual fracture zone exists consisting of subsurface micro-cracks 66 that may hinder retention of the filler material 56 and promote abrasion wear during fuel pump operation as illustrated in FIG. 5.

Figure 6:
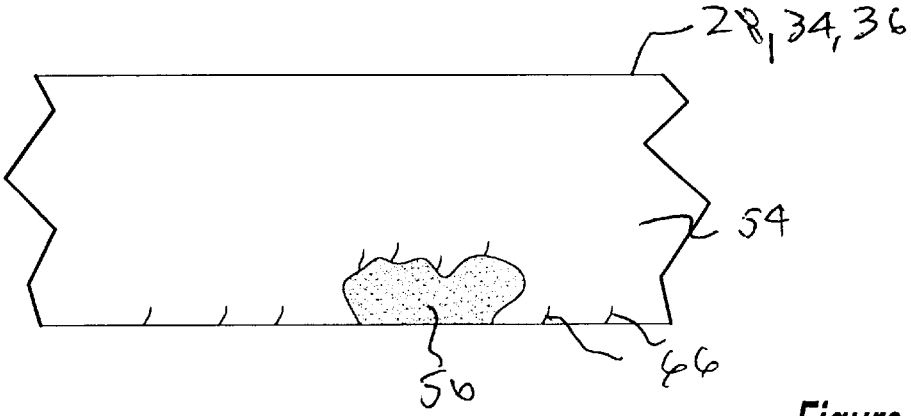
FIG. 6 is an enlarged fragmentary elevational view of the portion of FIG. 2 illustrating micro-cracks.

To minimize the residual fracture zone, a two-step lapping operation is used. The first step consists of the lapping operation described above that provides for fast material removal and hence, improved cycle time. The second step consists of adjusting the lapping parameters of the load 58, particle size of the abrasive media 62 and rotational speed of the lapping wheel 60 to obtain a low unit loading that will remove the final amount of material from the desired surface of the impeller 28 and/or plates 34,36 without propagating a deep fracture zone 64. The fracture zone 64 created by the first step will be removed during the second step or secondary "polishing" operation. It should be appreciated that the above lapping process includes a secondary operation that will provide a finished part with minimal subsurface micro-cracks 66 as illustrated in FIG. 6 and thus, improved filler retention and robustness to abrasion during fuel pump operation.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An abrasion wear resistant fuel pump for a vehicle comprising:

a pump section having a flow channel and a rotatable impeller cooperating with said flow channel to pump fuel therethrough;

a motor section disposed adjacent said pump section and having a motor to rotate said impeller;

an outlet section disposed adjacent said motor section to allow pumped fuel to exit said fuel pump; and said pump section including a plurality of plates disposed axially adjacent to and cooperating with the impeller, said impeller and said plates being made of a composite material that improves abrasion wear characteristics therebetween.

2. An abrasion wear resistant fuel pump as set forth in claim 1 wherein said composite material comprises a base resin material and a filler material.

3. An abrasion wear resistant fuel pump as set forth in claim 2 wherein said base resin material is made of a blend of phenolic resin and phenoxy resin.

4. An abrasion wear resistant fuel pump as set forth in claim 3 wherein said phenoxy resin is made from a general formula:

$$—[O\text{-}PHENYL\text{-}C(CH_3)_2\text{-}PHENYL\text{-}O—CH_2—CH(OH)—CH_2—]_n—.$$

5. An abrasion wear resistant fuel pump as set forth in claim 1 wherein said impeller has a hub portion, a plurality of blades disposed circumferentially along said hub portion, and a peripheral ring portion extending radially from said blades having an axial sealing surface on both sides thereof.

6. An abrasion wear resistant fuel pump as set forth in claim 5 wherein said sealing surface is disposed between said impeller and said inlet plate and between said impeller and said outlet plate.

7. An abrasion wear resistant fuel pump as set forth in claim 2 wherein said base resin material has a content of at least 10% by weight of the total composition of the composite material.

8. An abrasion wear resistant fuel pump as set forth in claim 2 wherein said filler material has a hardness greater than 65 Rc.

9. An abrasion wear resistant fuel pump as set forth in claim 2 wherein said filler material is of a magnitude to produce 60% to 90% surface area coverage after lapping.

10. An abrasion wear resistant fuel pump as set forth in claim 2 wherein said filler material has two particle sizes differing by a factor of seven.

11. An abrasion wear resistant fuel pump as set forth in claim 2 wherein said filler material has a concentration ratio of 75/25 large particles to small particles.

12. An abrasion wear resistant fuel pump for a vehicle comprising:

a housing;

a pump section disposed in said housing having a flow channel and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump; and said pump section including an inner plate and an outer plate disposed axially adjacent to and cooperating with the impeller, said impeller and said inner plate and said outer plate being made of a composite material that improves abrasion wear characteristics therebetween.

13. An abrasion wear resistant fuel pump as set forth in claim 12 wherein said composite material comprises a base resin material and a filler material.

14. An abrasion wear resistant fuel pump as set forth in claim 13 wherein said base resin material is a blend of phenolic resin and phenoxy resin.

15. An abrasion wear resistant fuel pump as set forth in claim 14 wherein said phenoxy resin is made from a general formula:

$$—[O\text{-}PHENYL\text{-}C(CH_3)_2\text{-}PHENYL\text{-}O—CH_2—CH(OH)—CH_2—]_n—.$$

16. An abrasion wear resistant fuel pump as set forth in claim 13 wherein said filler material has a hardness greater than 65 Rc.

17. An abrasion wear resistant fuel pump as set forth in claim 13 wherein said filler material is of a magnitude to produce 60% to 90% surface area coverage after lapping.

18. An abrasion wear resistant fuel pump as set forth in claim 13 wherein said filler material has two particle sizes differing by a factor of seven.

19. An abrasion wear resistant fuel pump as set forth in claim 13 wherein said filler material has a concentration ratio of 75/25 large particles to small particles.

20. An abrasion wear resistant fuel pump for a vehicle comprising:

a housing;

a pump section disposed in said housing having a flow channel and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump; and said pump section including an inner plate and an outer plate disposed axially adjacent to and cooperating with the impeller, said impeller and said inner plate and said outer plate being made of a composite material comprising a base phenoxy resin material and a filler material having a hardness greater than 65 Rc.

* * * * *